US010039964B1

(12) United States Patent
Westrum et al.

(10) Patent No.: US 10,039,964 B1
(45) **Date of Patent: *Aug. 7, 2018**

(54) GOLF CLUB HEAD COMPRISING GLASS BUBBLE FILL MATERIAL

(71) Applicant: Callaway Golf Company, Carlsbad, CA (US)

(72) Inventors: Joshua D. Westrum, San Diego, CA (US); Hong G. Jeon, Carlsbad, CA (US); Scott Manwaring, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/718,285

(22) Filed: Sep. 28, 2017

Related U.S. Application Data

(62) Division of application No. 15/665,004, filed on Jul. 31, 2017, now Pat. No. 9,808,685.

(60) Provisional application No. 62/457,086, filed on Feb. 9, 2017.

(51) Int. Cl.
*A63B 53/04* (2015.01)
*A63B 60/00* (2015.01)

(52) U.S. Cl.
CPC ..... *A63B 53/0475* (2013.01); *A63B 60/00* (2015.10); *A63B 2060/002* (2015.10); *A63B 2209/00* (2013.01)

(58) Field of Classification Search
USPC ..... 473/324–350
See application file for complete search history.

(56) References Cited

U.S. PATENT DOCUMENTS

| | | | | |
|---|---|---|---|---|
| 4,650,626 | A * | 3/1987 | Kurokawa | B29C 45/14 264/261 |
| 5,007,643 | A * | 4/1991 | Okumoto | A63B 53/04 473/346 |
| 5,465,969 | A * | 11/1995 | Cadorniga | A63B 53/04 473/346 |
| 5,507,985 | A * | 4/1996 | Cadorniga | A63B 53/04 264/45.3 |
| 8,206,239 | B2 * | 6/2012 | Gilbert | A63B 53/047 473/324 |
| 9,808,685 | B1 * | 11/2017 | Westrum | A63B 53/0475 |
| 2008/0058117 | A1 * | 3/2008 | Roach | A63B 53/047 473/332 |

* cited by examiner

*Primary Examiner* — Alvin Hunter
(74) *Attorney, Agent, or Firm* — Rebecca Hanovice; Michael Catania; Sonia Lari

(57) ABSTRACT

A golf club head with at least one cavity including a fill material comprising a polymer and a plurality of microscopic glass bubbles, and methods of manufacturing such golf club heads, are disclosed herein. In particular, the golf club head is an iron having a striking face, a rear portion, and an internal cavity disposed behind the striking face, which is at least partially filled with the fill material. The plurality of microscopic glass bubbles constitutes at 5-70% of the volume of the fill material, and more preferably approximately 20-30% of the volume of the fill material. The polymer material preferably is a polyurethane having a Poisson's ratio of 0.40-0.50. In some embodiments, the fill material takes the form a medallion affixed to a rear surface of the striking face, while in others, the fill material is injected into the internal cavity.

20 Claims, 9 Drawing Sheets

GOLF CLUB HEAD COMPRISING GLASS BUBBLE FILL MATERIAL

CROSS REFERENCES TO RELATED APPLICATIONS

The present application is a divisional application of U.S. patent application Ser. No. 15/665,004, filed on Jul. 31, 2017, which claims priority to U.S. Provisional Patent Application No. 62/457,086, filed on Feb. 9, 2017, the disclosure of which is hereby incorporated by reference in its entirety herein.

STATEMENT REGARDING FEDERALLY SPONSORED RESEARCH OR DEVELOPMENT

Not Applicable

BACKGROUND OF THE INVENTION

Field of the Invention

The present invention relates to a golf club head. More specifically, the present invention relates to an iron-type golf club head comprising a novel polymeric fill material that improves the sound of the club head without significantly reducing the golf club head's ball speed or coefficient of restitution.

Description of the Related Art

Golf club heads, and particularly iron-type golf club heads, often include polymeric materials disposed behind the striking face to improve or dampen the sound of the head upon impact with a golf ball. For example, U.S. Pat. No. 5,492,327 discloses an iron with a damping material in a recess, U.S. Pat. No. 6,743,117 discloses a dampening insert behind a strike face insert in an iron, and U.S. Pat. No. 9,168,437 discloses an elastomeric insert attached to the back of the striking face of an iron. Unfortunately, while a polymer fill or insert can improve the sound of the golf club in which it is disposed, this configuration reduces ballspeed off the face, as well as the coefficient of restitution (COR) of the golf club head. This occurs because polymers such as urethane are rigid, with a Poisson's ratio of around 0.5, and when a polymer fills a cavity or space, the polymer prevents the golf club face from flexing. Therefore, there is a need for a golf club head comprising an improved fill material that also preserves, or otherwise optimizes, ballspeed and COR values.

BRIEF SUMMARY OF THE INVENTION

The golf club head comprises a material comprising microscopic glass bubbles (also referred to as hollow glass beads) mixed with a polymeric material, preferably urethane or silicone, at least partially filling a cavity within the club head or affixed to a portion of the club head in medallion form. The presence of the glass bubbles in the polymeric material prevents the COR of the golf club head from decreasing by more than 0.10, and more preferably by more than 0.05, when compared with a golf club head having all of the same features and characteristics but which lacks a polymeric fill material completely.

One aspect of the present invention is an iron-type golf club head comprising a body comprising a striking face, sole portion, top portion, rear portion, and cavity, and a fill material at least partially filling the cavity, wherein the fill material comprises a polymer material and a plurality of microscopic glass bubbles, and wherein the plurality of microscopic glass bubbles constitutes 5% to 70% of a volume of the fill material. In some embodiments, the polymer material may be selected from the group consisting of polyurethane and silicone, and in other embodiments, the plurality of microscopic glass bubbles may constitute at least 20% of the volume of the fill material. In a further embodiment, wherein the plurality of microscopic glass bubbles may constitute 25-30% of the volume of the fill material. In another embodiment, the polymer material may have a Poisson's ratio 0.00-0.50, and in a further embodiment, the polymer material may have a Poisson's ratio of 0.40-0.50. In yet another embodiment, when a central area of the face impacts a golf ball, the golf club head may have a pitch of 3000-6000 Hz, an amplitude of 90-100 dB, a duration of 1-2.5 ms, and a ball speed of at least 112.5 mph. In another embodiment, the fill material is formed into a medallion.

Another aspect of the present invention is a method comprising the steps of providing a golf club head comprising a body having at least one cavity, providing a polymer material, providing a plurality of microscopic glass bubbles, combining the plurality of microscopic glass bubbles with the polymer material to create a fill material, and injecting the fill material into the at least one cavity of the golf club head, wherein the plurality of microscopic glass bubbles constitutes 5-70% of a volume of the fill material. In some embodiments, the plurality of microscopic glass bubbles may constitute approximately least 25-30% of the volume of the fill material. In other embodiments, the polymer material may be selected from the group consisting of polyurethane and silicone and may have a Poisson's ratio of 0.40-0.50.

Yet another aspect of the present invention is a method comprising the steps of providing a golf club head comprising a body having at least one cavity, providing a polymer material, providing an agent material selected from the group consisting of a curative and a catalyst, providing a plurality of microscopic glass bubbles, combining the plurality of microscopic glass bubbles with the agent material to create an intermediary material, combining the intermediary material with the polymer material to create a fill material, and injecting the fill material into the at least one cavity of the golf club head, wherein the plurality of microscopic glass bubbles constitutes 5-70% of a volume of the intermediary material. In some embodiments, the fill material may comprise a 1:1 ratio of polymer material and intermediary material. In other embodiments, the plurality of microscopic glass bubbles may constitute approximately 20-30% of the volume of the intermediary material, and the polymer material may be selected from the group consisting of polyurethane and silicone.

Another aspect of the present invention is a method comprising the steps of providing a golf club head comprising a body having at least one cavity, providing a polymer material having a Poisson's ratio of 0.40-0.50, providing an agent material selected from the group consisting of a curative and a catalyst, providing a plurality of microscopic glass bubbles, combining the polymer material with the agent material to form an intermediary material, combining the plurality of microscopic glass bubbles with the intermediary material to create a fill material, injecting the fill material into the at least one cavity of the golf club head, and curing the fill material within the golf club head, wherein the plurality of microscopic glass bubbles constitutes 5-70% of a volume of the fill material. In some embodiments, the golf club head may be an iron-type golf club head, the plurality of microscopic glass bubbles may constitute approximately 20-30% of the volume of the fill material, and the polymer material may be selected from the group consisting of polyurethane and silicone.

Yet another aspect of the present invention is a method comprising the steps of providing an iron-type golf club head comprising a body having a striking face, a sole portion, a top portion, a rear portion, and at least one cavity, providing a polyurethane material, providing an agent material selected from the group consisting of a curative and a catalyst, providing a plurality of microscopic glass bubbles, combining the plurality of microscopic glass bubbles with the agent material at a 5:3 ratio to form an intermediary material, combining the polymer material with the intermediary material to create a fill material, injecting the fill material into the at least one cavity of the iron-type golf club head, and curing the iron-type golf club head in an oven, wherein the plurality of microscopic glass constitutes at least 20% of a volume of the fill material, and wherein the polyurethane material has a Poisson's ratio of 0.40-0.50. In some embodiments, the at least one cavity may be disposed between the striking face and the rear portion, and the fill material may completely fill the at least one cavity. In other embodiments, the plurality of microscopic glass bubbles may constitute approximately 30% of the volume of the fill material.

Having briefly described the present invention, the above and further objects, features, and advantages thereof will be recognized by those skilled in the pertinent art from the following detailed description of the invention when taken in conjunction with the accompanying drawings.

DETAILED DESCRIPTION OF THE INVENTION

The present invention is directed to golf club heads, and particularly iron-type golf club heads, which include a novel fill material comprising a polymeric material and microscopic glass bubbles, also referred to herein as microscopic, hollow glass beads. The glass bubbles serve two purposes when incorporated with a polymeric material: (1) they lighten the overall fill weight by replacing elastomer with air, thus lowering the material's specific gravity; and (2) they increase the porosity of the fill material, allowing for the formation of micro-holes in the polymeric material. The micro-holes are little air pockets that allow the polymer to flex when the club head impacts a golf ball, thus increasing the COR of the head while at the same time maintaining the sound improvement provided by the polymer itself, such as reduction in dB level and duration. The polymeric material preferably is an elastomer such as polyurethane or silicone having a Poisson's ratio of 0.00-0.50, and more preferably 0.40-0.50, and the glass bubbles preferably are measured in D50 micron, which is the median particle size for a measured sample, each glass bubble having a diameter of approximately 18-50 microns.

Figure 1:
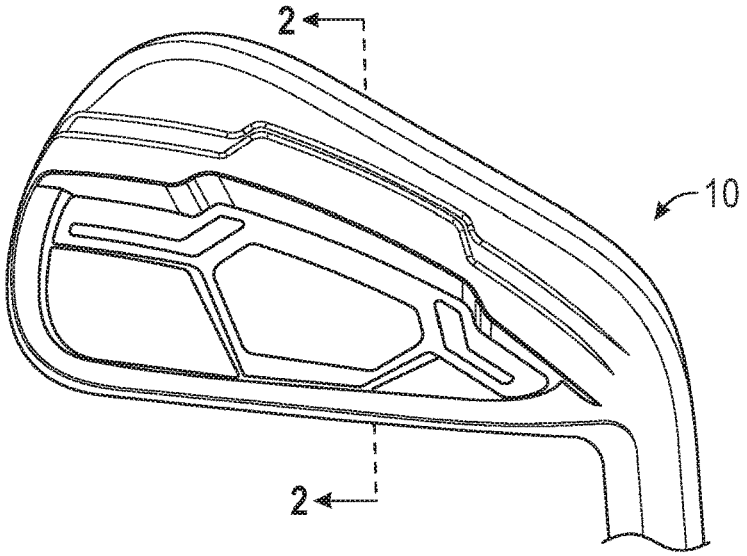
FIG. 1 is a rear elevational view of an iron-type golf club head of the present invention.
Figure 2:
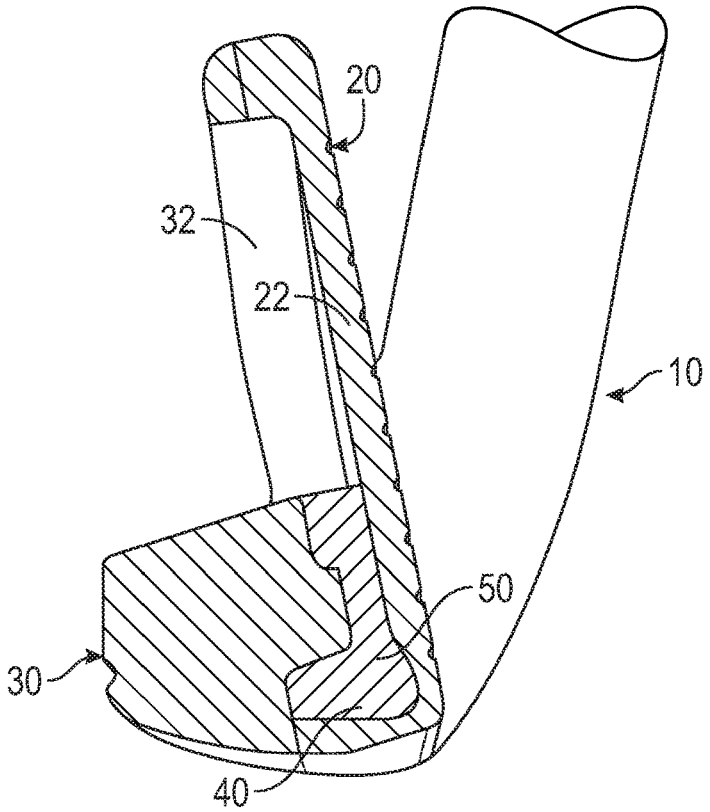
FIG. 2 is a cross-sectional view of the embodiment shown in FIG. 1 along lines 2-2.
Figure 3:
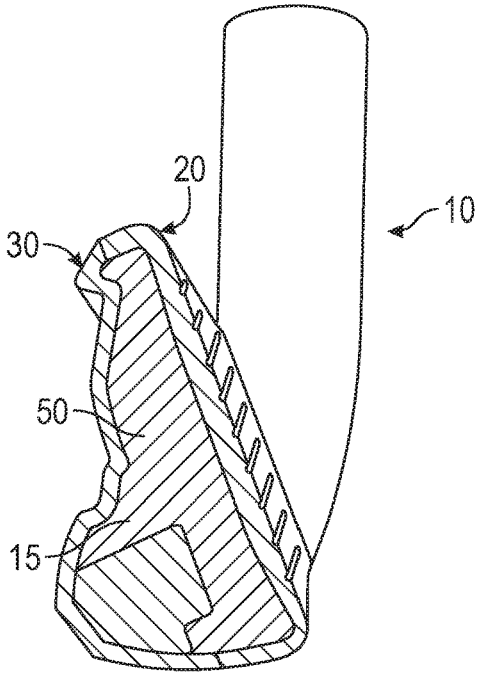
FIG. 3 is a cross-sectional view of a second embodiment of the present invention.
Figure 4:
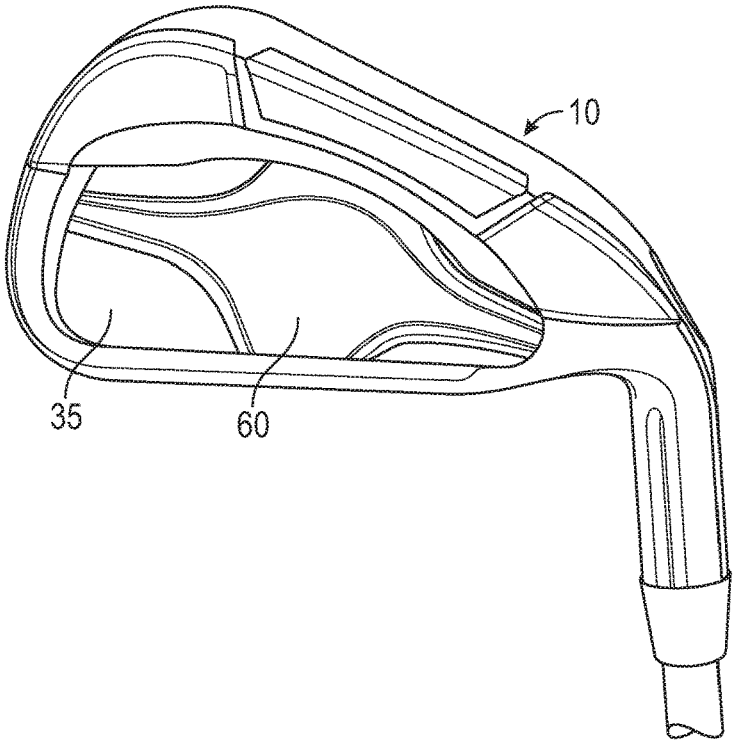
FIG. 4 is a rear elevational view of a third embodiment of the present invention.

A preferred embodiment of the golf club head is shown in FIGS. 1 and 2. In this embodiment, the golf club head 10 is a cavity back iron having a face cup 20, a body 30, and a cavity 40 between the body and the striking portion 22 of the face cup. The cavity 40 is completely filled with the glass bubble fill material 50, which does not extend into the upper cavity portion 32 of the body 30. In an alternative embodiment, shown in FIG. 3, the golf club head 10 is a closed cavity back iron with a hollow interior 15, which is completely filled with the glass bead fill material 50. In yet another embodiment, shown in FIG. 4, the golf club head 10 has an open cavity back 35 with a medallion 60 molded or otherwise formed from the glass bead fill material 50 affixed to a rear surface 23 of the striking portion 22. In each of the embodiments, the glass bubbles in the novel fill material 50 preferably constitute 5% to 70% by volume of the fill material 50, more preferably at least 20% of the volume, and most preferably approximately 25-30% of the fill material's 50 volume.

Figure 5:
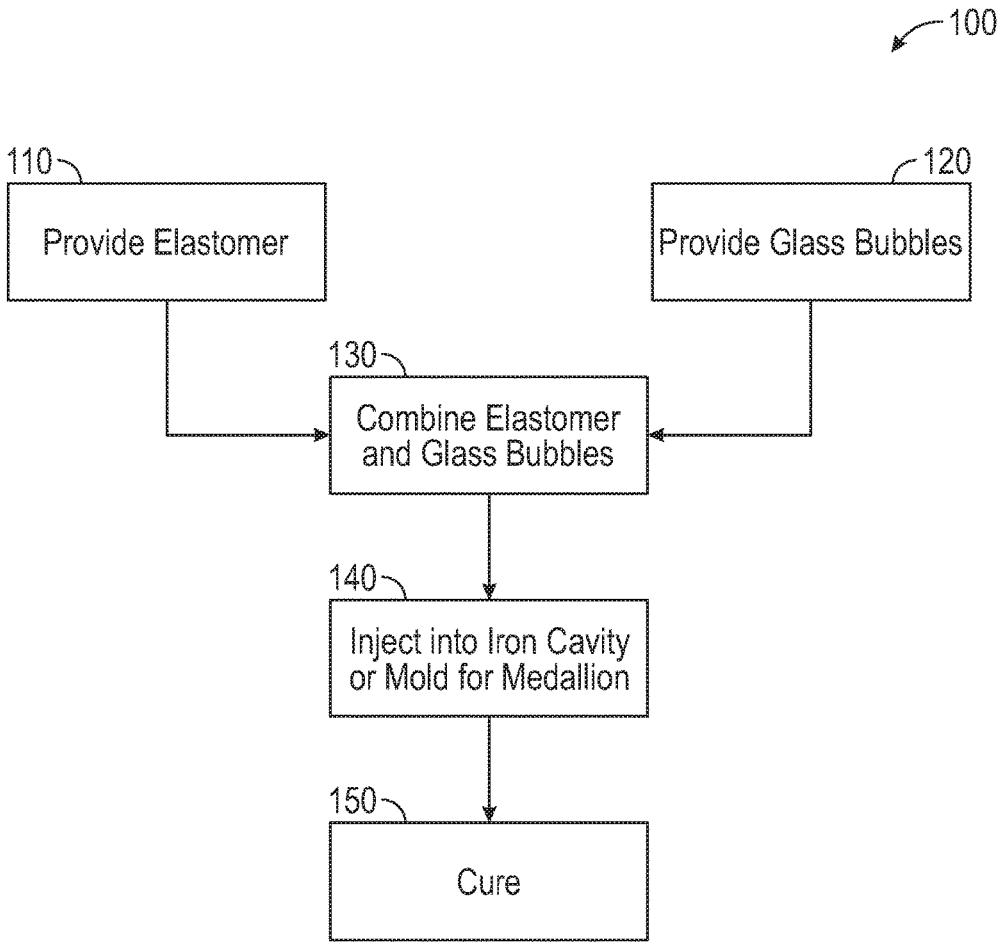
FIG. 5 is a flow chart illustrating a first method of preparing the polymer fill material shown in FIGS. 2-4.

There are several methods of manufacturing the glass bubble fill material 50 and incorporating it into the golf club head 10 according to the present invention. The first method 100, shown in FIG. 5, comprises the steps of providing an elastomer material 110 such as polyurethane, providing the microscopic glass bubbles 120, combining the glass bubbles with the elastomer material 130 so that the glass bubbles form 5-70% of the volume of the resulting mixture, and more preferably approximately 25-30% of the volume of the resulting material, injecting the resulting mixture into a cavity 40 or hollow interior 15 of the golf club head, or a mold for a medallion 140, and then oven curing the mixture or otherwise allowing it to cure 150 (e.g., at air temperature for self-curing materials).

Figure 6:
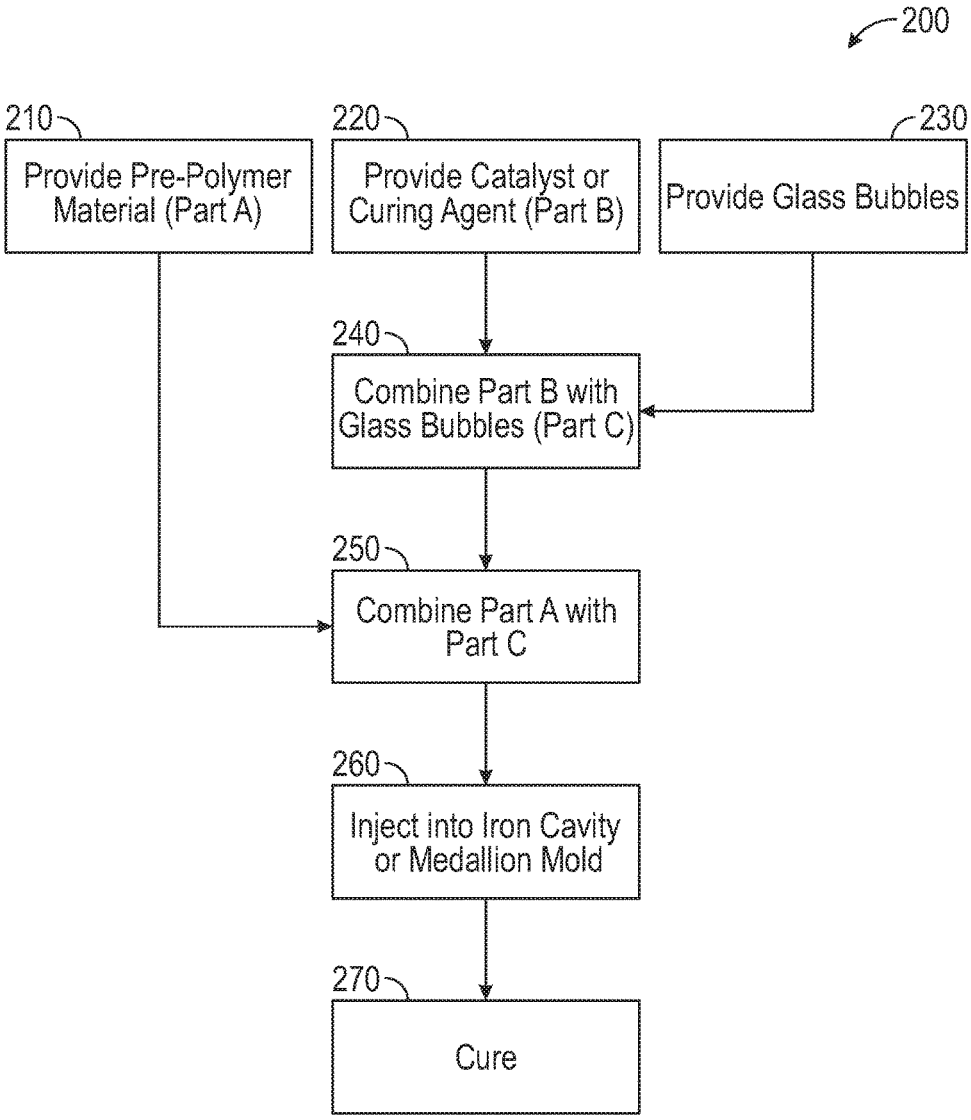
FIG. 6 is a flow chart illustrating a second method of preparing the polymer fill material shown in FIGS. 2-4.

The second, preferred method 200, shown in FIG. 6, comprises the steps of providing a pre-polymer resin (Part A) 210 such as a polyurethane or silicone, providing a curing or catalyst agent (Part B) 220, and providing the glass bubbles 230, combining the curing or catalyst agent (Part B) with the glass bubbles to form an intermediary material (Part C) 240 that is 5-70% by volume of glass bubbles, and more preferably 25-30% by volume, combining the intermediary material (Part C) with the polymer resin (Part A) 250, preferably in a 1:1 Part A to Part B ratio, to form a final mixture, injecting the final mixture into a cavity 4 or hollow interior 15 of the golf club head, or a mold for a medallion 260, and then oven curing the mixture or otherwise allowing it to cure 270. The benefit of this method 200 is that the intermediary material (Part C) can be prepared and placed into storage until a manufacturer is ready to catalyze the pre-polymer resin.

Figure 7:
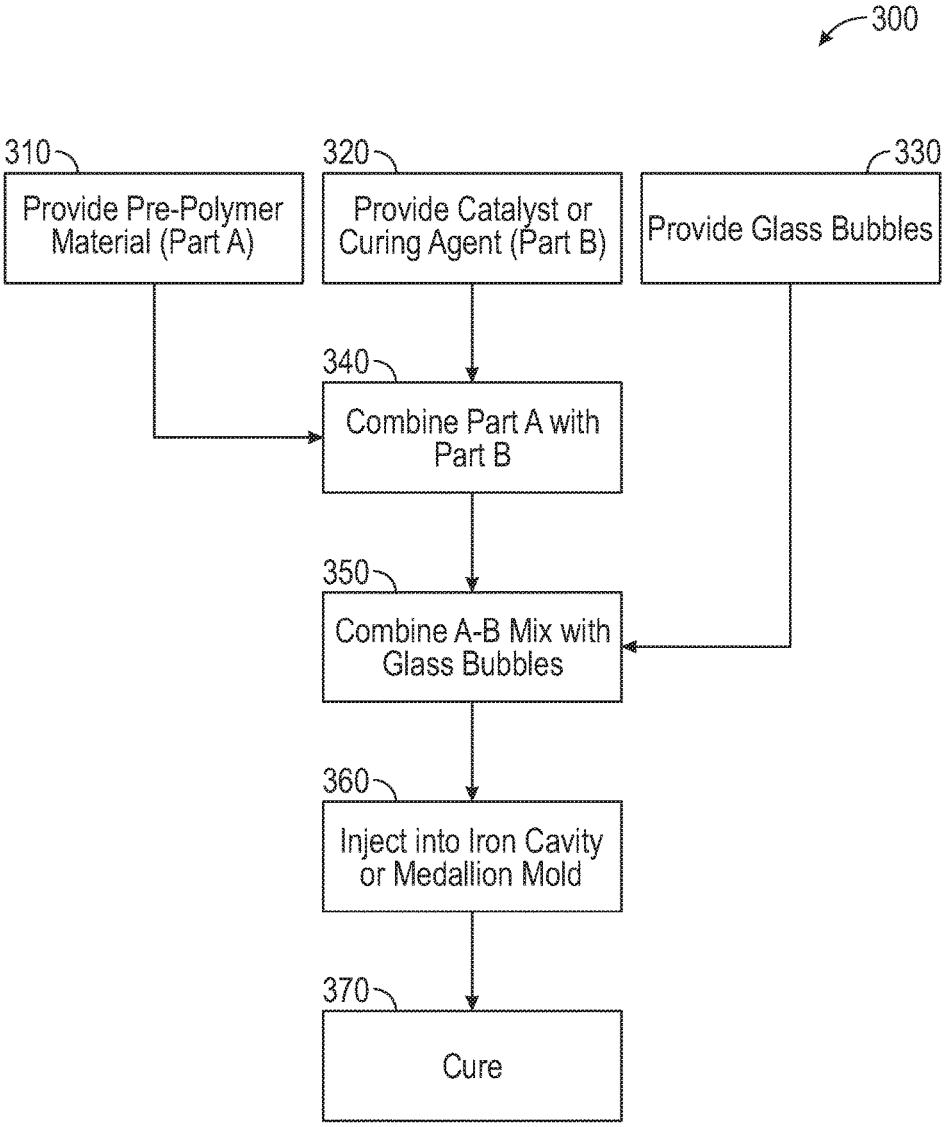
FIG. 7 is a flow chart illustrating a third method of preparing the polymer fill material shown in FIGS. 2-4.

The third method of the present invention is shown in FIG. 7. This method 300 comprises the steps of providing a pre-polymer resin (Part A) 310 (preferably polyurethane or silicone), providing a curing or catalyst agent (Part B) 320, and providing the glass bubbles 330, combining the polymer resin (Part A) with the curing or catalyst agent (Part B) 340, preferably in a 1:1 Part A to Part B ratio, to form an intermediary material, combining the intermediary material with glass bubbles 350 so that the glass bubbles are 5-70% of the volume of the resulting material, and more preferably 25-30% of the volume, injecting the resulting material into a cavity 40 or hollow interior 15 of the golf club head, or a mold for a medallion 360, and then oven curing the mixture or otherwise allowing it to cure 370.

In order to assess the COR performance of the inventive material, test iron-type golf club heads 10 having unfilled (empty) cavities were created and tested, and compared against golf club heads 10 having the same construction and filled with (1) the novel glass bubble fill material 50 comprising polyurethane and made using one of the second 200 and third methods 300 and (2) polyurethane only. As shown in Tables 1 and 2, the polyurethane-only fill significantly lowers the COR of the golf club head 10. In contrast, when a golf club head cavity is filled with the glass bubble fill material 50 of the present invention, the COR decreases, on average, only by 0.04, thereby retaining the performance benefits of an unfilled golf club head 10. This is particularly evident when the glass bubbles or hollow glass beads constitute approximately 25% or 30% of the volume of the fill material 50, as shown in Table 1.

TABLE 1

| Test Club No. | COR (no fill) | | Change in COR |
|---|---|---|---|
| | | COR (polyurethane only) | |
| 1. | 0.827 | 0.806 | −0.021 |
| 2. | 0.827 | 0.806 | −0.021 |
| 3. | 0.824 | 0.812 | −0.012 |
| 4. | 0.818 | 0.796 | −0.022 |
| 5. | 0.813 | 0.793 | −0.020 |
| | | Average change in COR | −0.019 |
| | | COR (30% glass bubble fill) | |
| 6. | 0.825 | 0.820 | −0.005 |
| 7. | 0.823 | 0.818 | −0.005 |
| 8. | 0.826 | 0.821 | −0.005 |
| 9. | 0.825 | 0.821 | −0.004 |
| 10. | 0.826 | 0.823 | −0.003 |
| 11. | 0.825 | 0.823 | −0.002 |
| 12. | 0.823 | 0.817 | −0.006 |
| 13. | 0.821 | 0.817 | −0.004 |
| 14. | 0.818 | 0.816 | −0.002 |
| 15. | 0.816 | 0.813 | −0.003 |
| 16. | 0.825 | 0.821 | −0.004 |
| 17. | 0.825 | 0.817 | −0.008 |
| | | COR (25% glass bubble fill) | |
| 18. | 0.824 | 0.821 | −0.003 |
| 21. | 0.823 | 0.817 | −0.006 |
| | | Average change in COR | −0.004 |

TABLE 2

| Test Club No. | COR (no fill) | | Change in COR |
|---|---|---|---|
| | | COR (polyurethane only) | |
| 1. | 0.813 | 0.793 | −0.20 |
| | | COR (5% glass bubble fill) | |
| 2. | 0.815 | 0.804 | −0.11 |

Figure 8:
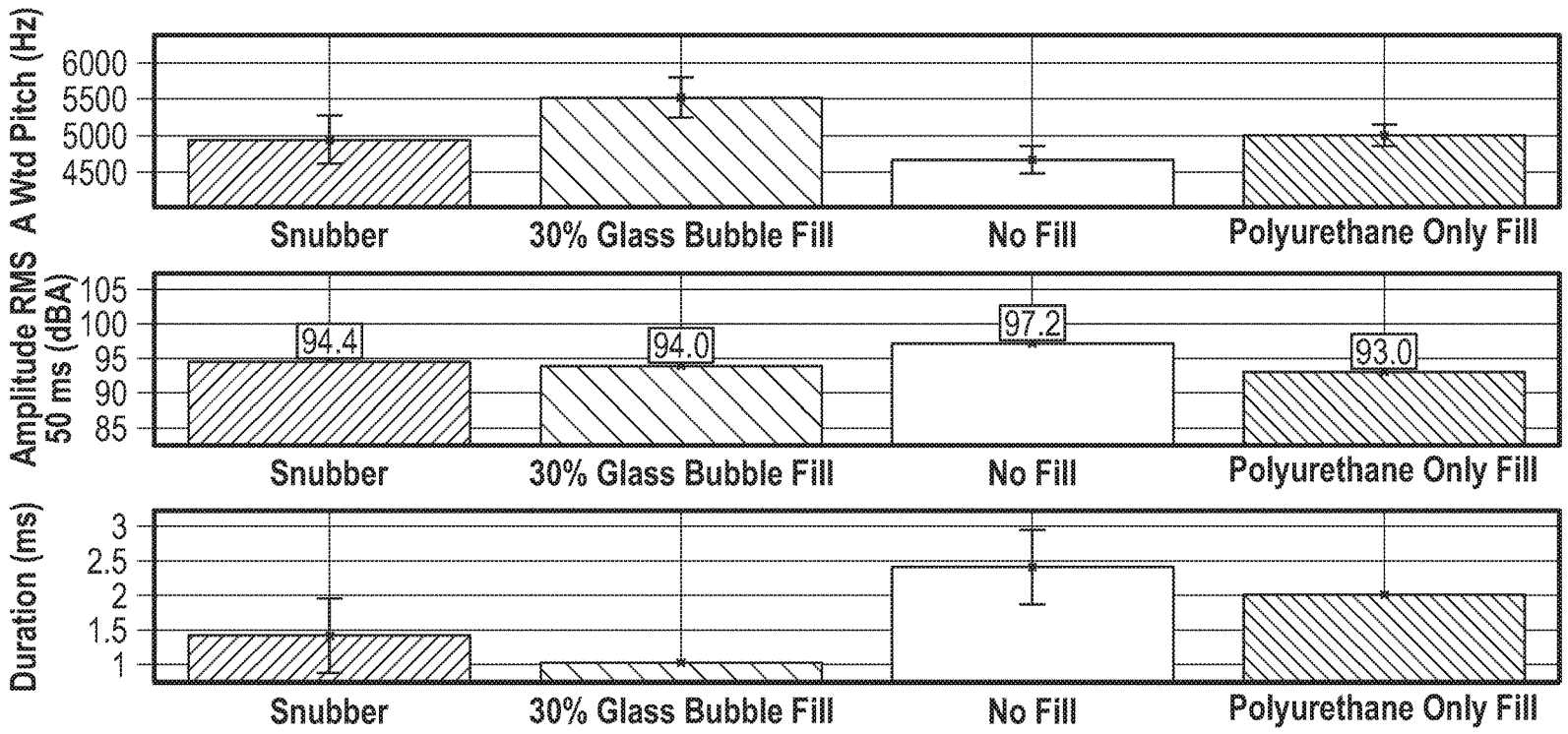
FIGS. 8-9 are charts showing sound measurements of the golf club head shown in FIG. 1 with and without different polymer fill materials and configurations.
Figure 9:
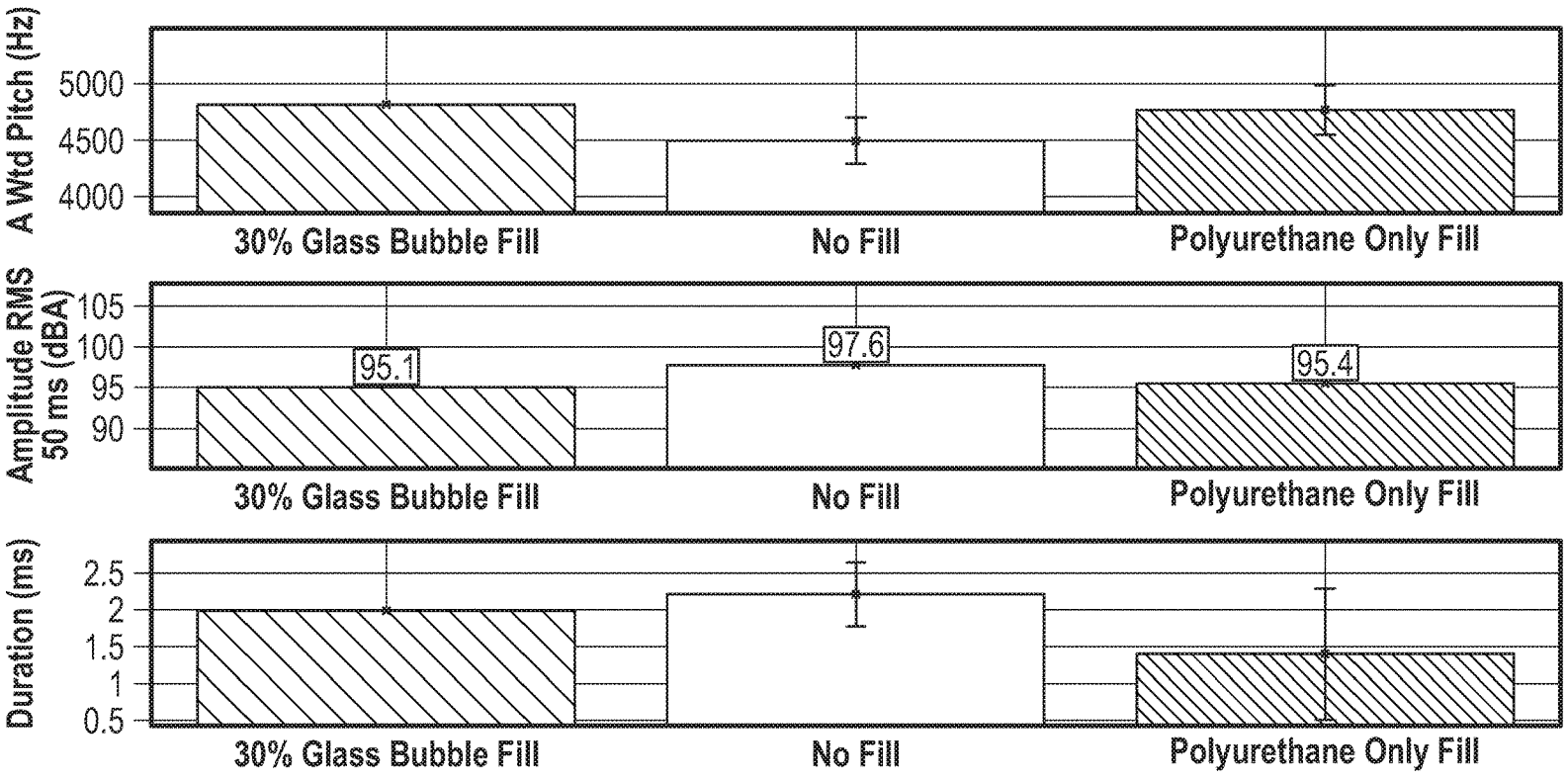

In order to assess sound performance, another group of test golf club heads 10 incorporating the 30% by volume novel glass bubble fill material 50 comprising polyurethane and made using one of the second 200 and third methods 300 were tested and compared with golf club heads 10 having: (1) the same construction and filled with only polyurethane; (2) no polyurethane filler at all; and (3) a small polyurethane snubber insert. As shown in FIGS. 8 and 9, the 30% by volume glass bubble fill material 50 improves the pitch and amplitude of the golf club head 10 upon impact with a golf ball compared to a polyurethane-only fill, thereby improving the overall sound of the golf club head 10. Preferably, a golf club head 10 incorporating the novel fill material has a pitch upon impact with a golf ball of 3000-6000 Hz, and more preferably of 4500-6000 Hz, an amplitude of 90-100 dB, and a duration of 1.0-2.5 ms.

Figure 10:
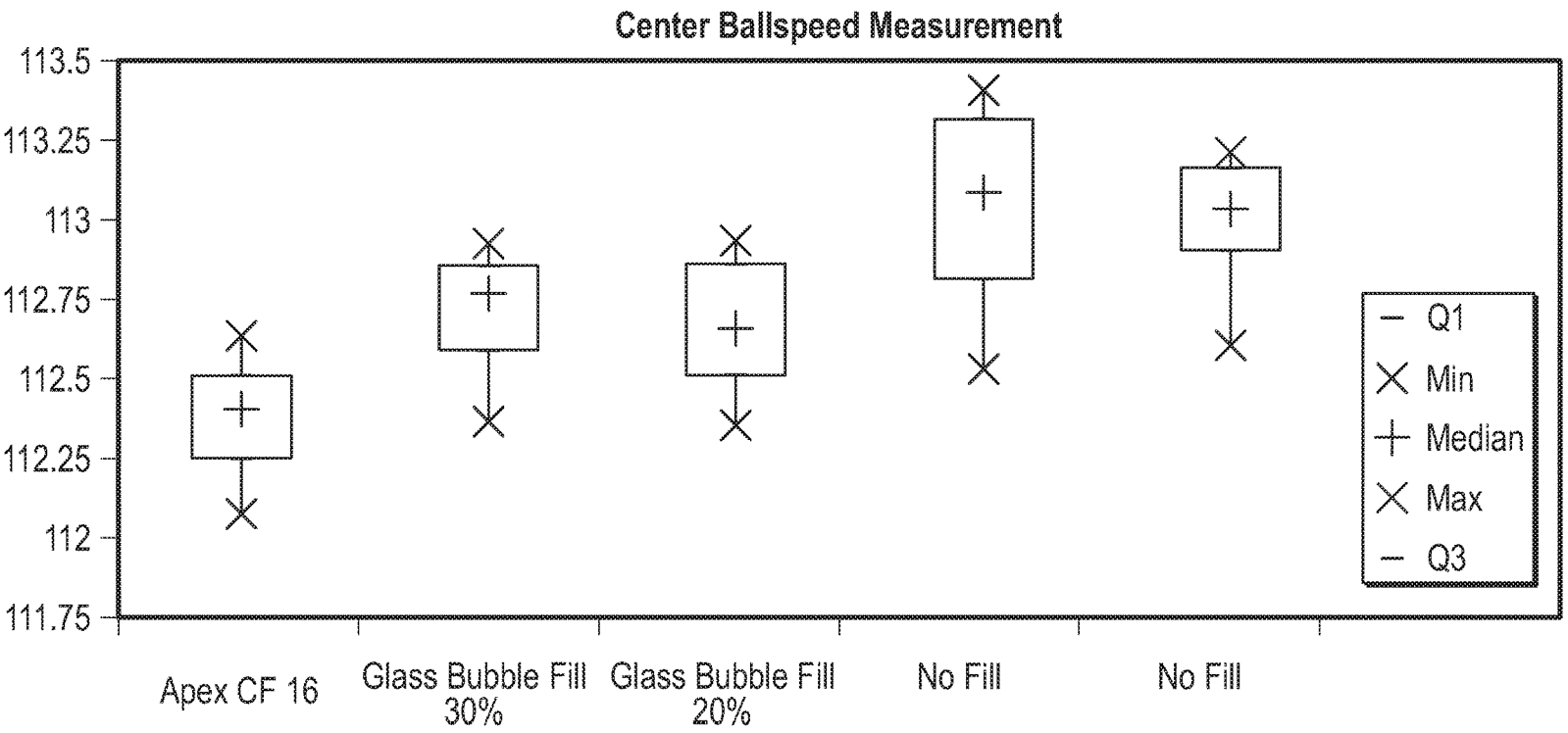
FIG. 10 is a box plot showing ball speed measurements taken from a central area of the face of test 6 iron heads having different polymer fill materials and configurations.
Figure 11:
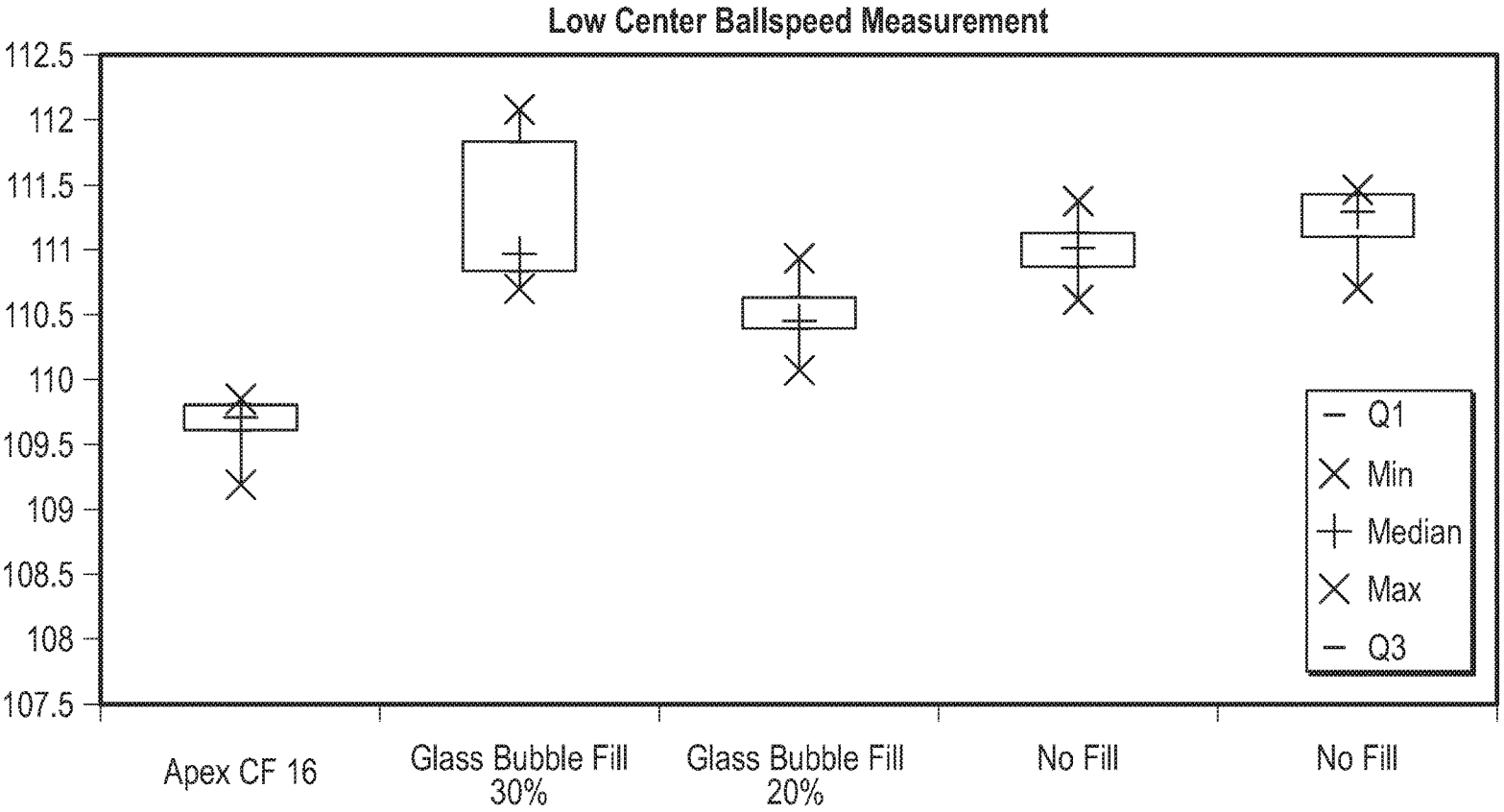
FIG. 11 is a box plot showing ball speed measurements taken from a low-central area of the face of test 6 iron heads having different polymer fill materials and configurations.

To assess the effects of the novel fill material on ball speed performance, the performance of a Callaway Golf Apex CF 16 6-iron comprising a small polymeric snubber was compared with the performance of test 6-irons having no fill, test 6-irons with a fill having 30% by volume microscopic glass bubbles, and test 6-irons with a fill having 20% by volume microscopic glass bubbles. As shown in FIGS. 10 and 11, the test irons comprising the novel, microscopic glass bubble fill had a higher median ball speed measured at both the center and low center of the striking face compared with the Apex CF 16 6-iron, and approached or surpassed the ball speed of test clubs lacking a fill material.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim:

1. A method comprising the steps of:

providing a golf club head comprising a body having at least one cavity;

providing a polymer material;

providing an agent material selected from the group consisting of a curative and a catalyst;

providing a plurality of microscopic glass bubbles;

combining the plurality of microscopic glass bubbles with the agent material to create an intermediary material;

combining the intermediary material with the polymer material to create a fill material; and injecting the fill material into the at least one cavity of the golf club head.

2. The method of claim 1, wherein the plurality of microscopic glass bubbles is combined with the agent material at a 5:3 ratio, and wherein the fill material comprises a 1:1 ratio of polymer material and intermediary material.

3. The method of claim 1, wherein the plurality of microscopic glass bubbles constitutes 5-70% of a volume of the intermediary material.

4. The method of claim 3, wherein the plurality of microscopic glass bubbles constitutes approximately 20-30% of the volume of the intermediary material.

5. The method of claim 1, wherein the polymer material has a Poisson's ratio of 0.40-0.50.

6. The method of claim 1, wherein the polymer material is selected from the group consisting of polyurethane and silicone, and wherein each of the plurality of microscopic glass bubbles has a diameter of approximately 18-50 microns.

7. The method of claim 1, wherein the golf club head is an iron-type golf club head comprising a body having a striking face, a sole portion, a top portion, and a rear portion, wherein the at least one cavity is disposed between the striking face and the rear portion, and wherein the fill material completely fills the at least one cavity.

8. The method of claim 1, further comprising the step of curing the fill material within the at least one cavity of the golf club head after the step of injecting the fill material into the at least one cavity of the golf club head.

9. The method of claim 8, wherein the step of curing the fill material comprises curing the golf club head in an oven.

10. A method comprising the steps of:

providing a golf club head comprising a body having at least one cavity;

providing a polymer material;

providing an agent material selected from the group consisting of a curative and a catalyst;

providing a plurality of microscopic glass bubbles;

combining the polymer material with the agent material to form an intermediary material;

combining the plurality of microscopic glass bubbles with the intermediary material to create a fill material;

injecting the fill material into the at least one cavity of the golf club head; and curing the fill material within the golf club head.

11. The method of claim 10, wherein the plurality of microscopic glass bubbles constitutes 5-70% of a volume of the fill material.

12. The method of claim 11, wherein the plurality of microscopic glass bubbles constitutes approximately 20-30% of the volume of the fill material.

13. The method of claim 10, wherein the polymer material is selected from the group consisting of polyurethane and silicone, and wherein each of the plurality of microscopic glass bubbles has a diameter of approximately 18-50 microns.

14. The method of claim 13, wherein the polymer material has a Poisson's ratio of 0.40-0.50.

15. A method of manufacturing a medallion for a golf club head, the method comprising the steps of:

providing a mold for a golf club head medallion;

providing a polymer material having a Poisson's ratio of 0.40-0.50;

providing an agent material selected from the group consisting of a curative and a catalyst;

providing a plurality of microscopic glass bubbles;

combining the plurality of microscopic glass bubbles with the agent material to create an intermediary material;

combining the intermediary material with the polymer material to create a fill material; and injecting the fill material into the mold.

16. The method of claim 15, further comprising the step of allowing the fill material to cure within the mold after the step of injecting the fill material into the mold.

17. The method of claim 15, further comprising the step of curing the fill material within the mold after the step of injecting the fill material into the mold.

18. The method of claim 15, wherein the plurality of microscopic glass bubbles constitutes 5-70% of a volume of the intermediary material.

19. The method of claim 18, wherein the plurality of microscopic glass bubbles constitutes approximately 20-30% of the volume of the intermediary material.

20. The method of claim 15, wherein each of the plurality of microscopic glass bubbles has a diameter of approximately 18-50 microns.

* * * * *